US007411358B2

(12) United States Patent
Shimura et al.

(10) Patent No.: US 7,411,358 B2
(45) Date of Patent: Aug. 12, 2008

(54) INVERTER CIRCUIT, BACKLIGHT ASSEMBLY, AND LIQUID CRYSTAL DISPLAY WITH BACKLIGHT ASSEMBLY

(75) Inventors: Tatsuhisa Shimura, Tokyo (JP); Takashi Kinoshita, Tokyo (JP)

(73) Assignee: Samsung Electronics Co., Ltd. (KR)

( * ) Notice: Subject to any disclaimer, the term of this patent is extended or adjusted under 35 U.S.C. 154(b) by 147 days.

(21) Appl. No.: 11/521,111

(22) Filed: Sep. 14, 2006

(65) Prior Publication Data

US 2007/0126370 A1 Jun. 7, 2007

(30) Foreign Application Priority Data

Dec. 7, 2005 (KR) ..... 10-2005-0118903

(51) Int. Cl.
*H05B 41/14* (2006.01)

(52) U.S. Cl. ..... 315/282; 315/277; 315/312; 315/129; 345/102

(58) Field of Classification Search ..... 315/276–278, 315/274, 282, 312, 291, DIG. 2, 224, 129, 315/119; 345/102, 87, 84, 55, 30; 349/70, 349/61, 56

See application file for complete search history.

(56) References Cited

U.S. PATENT DOCUMENTS 6,781,325 B2 * 8/2004 Lee ..... 315/282
7,061,183 B1 * 6/2006 Ball ..... 315/277
7,141,933 B2 * 11/2006 Ball ..... 315/312
7,250,731 B2 * 7/2007 Jin ..... 315/282
7,294,971 B2 * 11/2007 Jin ..... 315/177

FOREIGN PATENT DOCUMENTS

| | | |
|---|---|---|
| JP | 2005-011634 | 1/2005 |
| JP | 2005049747 A | 2/2005 |
| KR | 10-2005-0067681 A | 7/2005 |
| KR | 10-2005-0078469 A | 8/2005 |

* cited by examiner

*Primary Examiner*—Douglas W Owens
*Assistant Examiner*—Ephrem Alemu
(74) *Attorney, Agent, or Firm*—Cantor Colburn LLP

(57) ABSTRACT

In an inverter circuit for a backlight assembly, a first sinusoidal voltage and a second sinusoidal voltage having an opposite polarity to that of the first sinusoidal voltage are applied across terminals of 2n CCFLs. Each of respective primary coils of n first balance transformers are connected in series with corresponding first terminals of a first set of n CCFLs from the 2n CCFLs. Each of respective primary coils of n second balance transformers are connected in series with corresponding first terminals of a second set of n CCFLs from the 2n CCFLs. The secondary coils of the first balance transformers and the secondary coils of the second balance transformers are connected in series with each other to form a loop. Accordingly, the backlight assembly makes it easy to troubleshoot a failure in the CCFLs.

15 Claims, 10 Drawing Sheets

INVERTER CIRCUIT, BACKLIGHT ASSEMBLY, AND LIQUID CRYSTAL DISPLAY WITH BACKLIGHT ASSEMBLY

CROSS-REFERENCE TO RELATED APPLICATION

This application claims priority to Korean Patent Application No. 2005-118903 filed on Dec. 7, 2005 and all the benefits accruing therefrom under 35 USC§ 119, the entire contents of which are incorporated herein by reference.

BACKGROUND OF THE INVENTION

1. Field of the Invention

The present invention relates to electronic display devices. More particularly, the present invention relates to an inverter circuit, a backlight assembly, and a liquid crystal display with the backlight assembly.

2. Description of the Related Art

Recently, information processing devices have rapidly evolved to encompass a wide variety of physical configurations and functionalities. Information processed by these processing devices takes the form of an electrical signal. Therefore, users require a display device to visually recognize information processed by the information processing devices.

One example of an existing display device is a flat panel display such as a liquid crystal display ("LCD"). An LCD displays an image using liquid crystals. Relative to other display devices, an LCD is thin, lightweight, consumes little power, and utilizes a low driving voltage. Therefore, an LCD is widely used in various fields.

Such an LCD includes a liquid crystal panel displaying an image and a backlight assembly providing light to the liquid crystal panel. (An illustrative example of an LCD panel is disclosed, for example, in Japanese Patent Publication No. 2005-49747).

FIG. 9 is a circuit diagram of a conventional backlight assembly. FIG. 10 illustrates an exemplary arrangement for the conventional backlight assembly.

Referring to FIG. 9, the conventional backlight assembly includes twenty-four cold cathode fluorescent lamps ("CCFLs") 910 and twenty-four balance transformers 920*a*-920*x*. As a liquid crystal panel increases in size, the backlight assembly may be equipped with a plurality of CCFLs to provide uniform brightness in the liquid crystal panel.

Sinusoidal voltages are applied from an inverter 900 to the CCFLs 910, and thus sinusoidal currents flow through the CCFLs 910. If sinusoidal voltages with the same polarity are applied to respective first terminals of the CCFLs 910, interference with a driving circuit of the liquid crystal panel occurs to generate interference pattern noise on the liquid crystal panel. Additionally, in the case of a large-sized LCD utilizing CCFLs 910 having a long length, when the CCFLs 910 are driven by an one-side-high, voltage-driving method, it is virtually impossible to maintain uniform brightness in a longitudinal direction along the CCFLs 910. To prevent these problems, the CCFLs 910 are divided into two groups as illustrated in FIG. 9, and high sinusoidal voltages with opposite polarities are applied, respectively, to the two groups. That is, the inverter 900 is configured to output both a positive high voltage ("PHV") and a negative high voltage ("NHV"). The positive high voltage/negative high voltage is applied to the left side/right side, respectively, of the odd-numbered CCFLs 910 (when numbered from the top), and to the right sides/left sides, respectively, of the even-numbered CCFLs 910.

The CCFLs 910 have a negative resistance and are all connected in parallel to each another. Therefore, when a current starts to flow through a given one of the CCFLs 910, the resistance of this CCFL decreases and thus a current easily flows through this CCFL. Since current is concentrated at this CCFL, the remaining CCFLs are not turned on. To prevent this problem, the balance transformers 920*a*-920*x* are connected in series to the CCFLs 910, as illustrated in FIG. 9.

The balance transformers 920*a*-920*l* are disposed at the left sides of the CCFLs 910, while the balance transformers 920*m*-920*x* are disposed at the right sides of the CCFLs 910. The balance transformers 920*a*~920*x* include primary coils 921*a*-921*x* connected directly to the CCFLs 910, respectively, and secondary coils 922*a*-922*b* installed adjacent to the primary coils 921*a*~921*x*, respectively. When a current flows through the CCFLs 910, a current flows through the primary coils 921*a*-921*x*, and a current also flows through the adjacent secondary coils 922*a*-922*x*. Since the secondary coils 922*a*-922*x* are connected in series to form a loop, the current flowing through the secondary coils 922*a*-922*x* causes the current to flow through the primary coils 921*a*-921*x*. As a result, currents flowing through the CCFLs 910 become substantially equal to one another.

In this configuration, a balancing voltage of each balance transformer necessary for balancing the CCFLs 910 can be obtained by grounding one point of the secondary coils 922*a*-922*x* and detecting a voltage between the grounded point and a detection node 940 remote from the grounded point. In a normal state, the balancing voltage is in the range of about 1 V to about 2 V.

This balancing voltage varies with the distribution of the resistances including the negative resistances of the CCFLs 910. Active use of this property enables detection of an open circuit or short circuit attributable to a failure in the CCFLs 910. That is, when an open circuit or short circuit occurs due to a failure in the CCFLs 910, a voltage (e.g., 5~6 V) higher than a normal voltage is detected at the detection node 940 as a result of the balancing operations of the balance transformers 920*a*-920*x*.

The conventional backlight assembly has two problems. One is lifetime degradation of the CCFLs 910, and another is that a temperature gradient makes it difficult to troubleshoot a failure in the CCFLs 910. These problems will now be described in greater detail with reference to FIGS. 9 and 10.

Referring to FIG. 9, the negative high voltage ("NHV") is directly applied to the CCFLs 910, while the positive high voltage ("PHV") is indirectly applied to the CCFLs 910 through the balance transformers 920*a*-920*x*. Thus, there is a difference between loading of the negative and positive high voltages NHV and PHV. In general, since the high voltage output uses virtually identical driving pulses with different polarities in the same circuit, an imbalance may occur in positive and negative driving pulses when there is a difference in loading. When an imbalance occurs in the driving pulses, the lifetime of the CCFLs 910 is shortened due to migration of mercury vapor therein.

Referring to FIG. 10, in the conventional backlight assembly, the CCFLs 910 are disposed horizontally in a vertically-standing protection structure 1020. The protection structure 1020 has a rear surface covered with a reflection plate 1010 and a front surface covered with a diffusion plate 1000. In the conventional backlight assembly, temperature increases in an upward direction due to heat by light emitted from the CCFLs 910, resulting in a temperature gradient.

The CCFLs 910 each have a temperature-dependent resistance. Therefore, due to the temperature gradient, the upper CCFLs 910 have a lower resistance while the lower CCFLs 910 have a higher resistance. To eliminate the resistance differential between the CCFLs 910, the balance transformers 920*a*-920*x* operate to balance the CCFLs 910. Accordingly, a voltage of, for example, about 3V is induced at the detection node 940. When an increase in voltage is detected at the detection node 940 in the conventional backlight assembly, it is virtually impossible to find out which of the resistance differences between the CCFLs 910, and an open or short circuit due to failure in a CCFL 910, has caused the voltage increase. Accordingly, it is difficult to accurately troubleshoot failure in the CCFL 910.

SUMMARY OF THE INVENTION

Exemplary embodiments of the present invention provide an inverter circuit which extends the life span of a CCFL.

Exemplary embodiments of the present invention provide a backlight assembly having an inverter circuit which extends the life span of a CCFL.

Exemplary embodiments of the present invention provide a liquid crystal display that uses a backlight assembly having an inverter circuit which extends the life span of a CCFL.

Pursuant to one illustrative embodiment of the present invention, an inverter circuits applies sinusoidal voltages to 2*n* CCFLs, wherein n is a positive integer. The inverter circuit includes n first balance transformers each including a primary coil and a secondary coil, and n second balance transformers each including a primary coil and a secondary coil. A first sinusoidal voltage, and a second sinusoidal voltage having a substantially opposite polarity to that of the first sinusoidal voltage, are applied, respectively, to a corresponding first terminal and a corresponding second terminal of each of the 2n CCFLs. Each respective primary coil of the n first balance transformers is connected in series to a corresponding first terminal of a CCFL included in a first set of n CCFLs from the 2n CCFLs such that the first sinusoidal voltage is applied to each respective first terminal of the first set of n CCFLs, while the second sinusoidal voltage is applied to each respective second terminal of the first set of n CCFLs. Each respective primary coil of the n second balance transformers is connected in series to a corresponding first terminal of a CCFL included in a second set of n CCFLs from the 2n CCFLs such that the second sinusoidal voltage is applied to each respective first terminal of the second set of n CCFLs, while the first sinusoidal voltage is applied to each respective second terminal of the second set of n CCFLs, wherein the first set of n CCFLs and the second set of n CCFLs are mutually exclusive. The secondary coils of the first balance transformers and the secondary coils of the second balance transformers are all connected in series with each other to form a loop.

A first circuit node to which respective secondary coils of the first and second balance transformers are connected is grounded, and the inverter circuit may further include a voltage detector to detect a voltage between the first circuit node and a detection node different from the first circuit node.

In the inverter circuit, the n CCFLs may be designated as odd-numbered CCFLs, in which case the remaining n CCFLs are designated as even-numbered CCFLs.

Pursuant to other illustrative embodiments of the present invention, a backlight assembly includes 2n CCFLs emitting light in response to sinusoidal voltages, and an inverter circuit applying the sinusoidal voltages to the 2n CCFLs, wherein n is a positive integer. The inverter circuit includes n first balance transformers each including a primary coil and a secondary coil, and n second balance transformers each including a primary coil and a secondary coil. A first sinusoidal voltage, and a second sinusoidal voltage having a substantially opposite polarity to that of the first sinusoidal voltage, are applied, respectively, to a corresponding first terminal and a corresponding second terminal of each of the 2n CCFLs. Each respective primary coil of the n first balance transformers is connected in series with a corresponding first terminal of a CCFL included in a first set of n CCFLs from the 2n CCFLs, such that the first sinusoidal voltage is applied to each respective first terminal of the first set of n CCFLs while the second sinusoidal voltage is applied to each respective second terminal of the first set of n CCFLs. Each respective primary coil of the n second balance transformers is connected in series to a corresponding first terminal of a CCFL included in a second set of n CCFLs from the 2n CCFLs, such that the second sinusoidal voltage is applied to each respective first terminal of the second set of n CCFLs, while the first sinusoidal voltage is applied to each respective second terminal of the second set of n CCFLs, wherein the first set of n CCFLs is mutually exclusive with the second set of n CCFLs. The secondary coils of the first balance transformers and the secondary coils of the second balance transformers are all connected in series with each other to form a loop.

A first circuit node to which respective secondary coils of the first and second balance transformers are connected is grounded, and the inverter circuit may further include a voltage detector to detect a voltage between the first circuit node and a detection node different from the first node.

In the inverter circuit, the n CCFLs may be designated as odd-numbered CCFLs, in which case the remaining n CCFLs are designated as even-numbered CCFLs.

Pursuant to other illustrative embodiments of the present invention, a liquid crystal display includes a liquid crystal panel that displays an image in response to at least one of ambient light and light from a backlight assembly. The backlight assembly includes 2n CCFLs that emit light in response to a sinusoidal voltage, and an inverter circuit that applies the sinusoidal voltage to 2n CCFLs, wherein n is a positive integer. The inverter circuit includes n first balance transformers each including a primary coil and a secondary coil, and n second balance transformers each including a primary coil and a secondary coil. A first sinusoidal voltage, and a second sinusoidal voltage having a substantially opposite polarity to that of the first sinusoidal voltage, are applied, respectively, to a corresponding first terminal and a corresponding second terminal of each of the 2n CCFLs. Each respective primary coil of the n first balance transformers is connected in series to a corresponding first terminal of a CCFL included in a first set of n CCFLs from the 2n CCFLs, such that the first sinusoidal voltage is applied to each respective first terminal of the first set of n CCFLs, while the second sinusoidal voltage is applied to each respective second terminal of the first set of n CCFLs. Each respective primary coil of the n second balance transformers is connected in series to a corresponding first terminal of a CCFL included in a second set of n CCFLs from the 2n CCFLs, such that the second sinusoidal voltage is applied to each respective first terminal of the second set of n CCFLs, while the first sinusoidal voltage is applied to each respective second terminal of the second set of n CCFLs, wherein the first set of n CCFLs is mutually exclusive with the second set of n CCFLs. The secondary coils of the first balance transformers and the secondary coils of the second balance transformers are all connected in series with each other to form a loop.

A first circuit node to which respective secondary coils of the first and second balance transformers are connected is grounded, and the inverter circuit may further include a voltage detector to detect a voltage between the first circuit node and a detection node different from the first circuit node.

In the inverter circuit, the n CCFLs may be designated as odd-numbered CCFLs, in which case the remaining n CCFLs are designated as even-numbered CCFLs.

BRIEF DESCRIPTION OF THE DRAWINGS

The above and other features and advantages of the invention will become more apparent by describing exemplary embodiments thereof with reference to the accompanying drawings, in which.

DETAILED DESCRIPTION OF THE INVENTION

Figure 1:
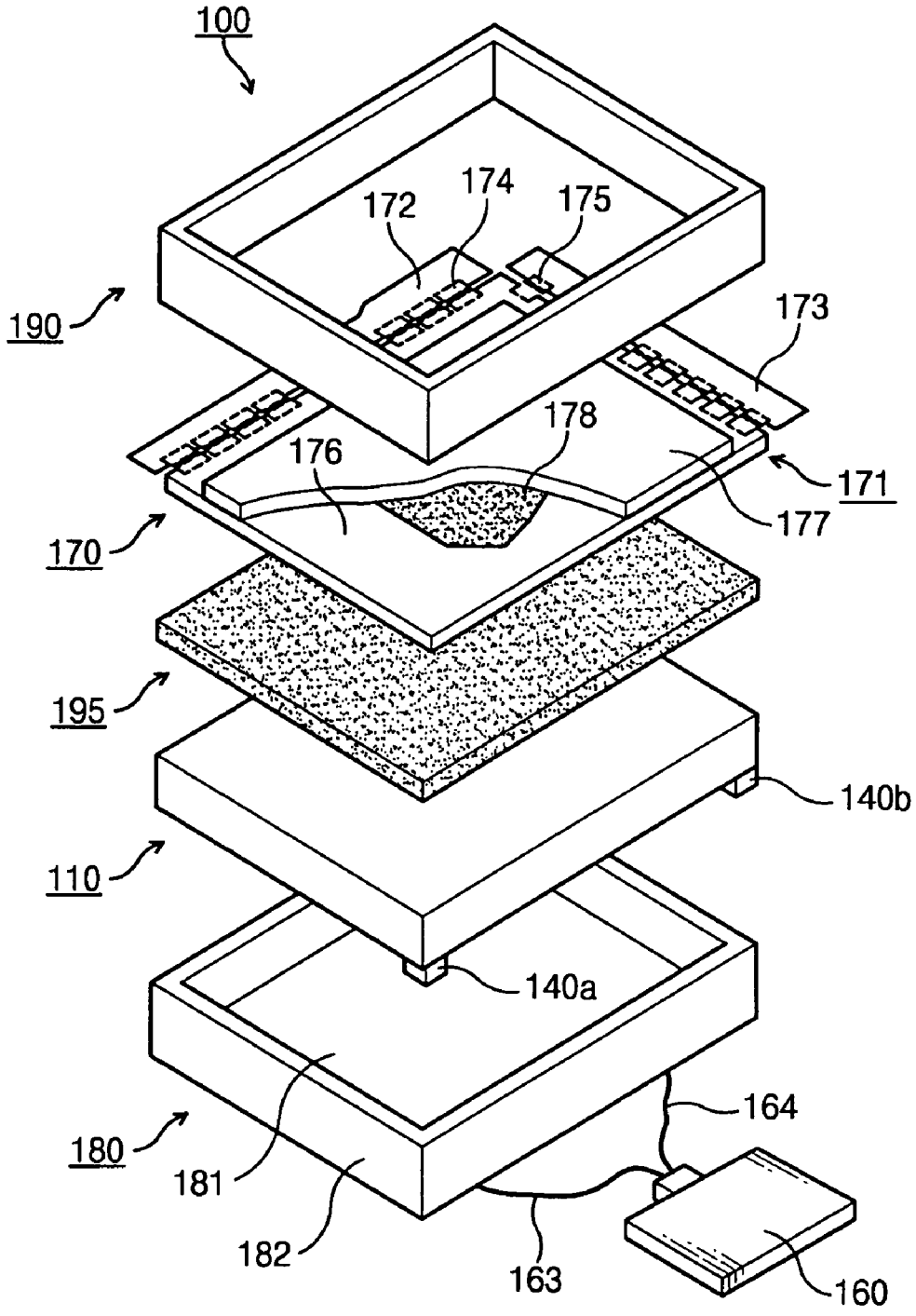
FIG. 1 is an exploded perspective view of an LCD according to an illustrative embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings.

Inverter circuits, backlight assemblies, and LCDs using backlight assemblies, according to embodiments of the present invention, will now be described with reference to FIGS. 1 through 8.

FIRST ILLUSTRATIVE EMBODIMENT

FIG. 1 is an exploded perspective view of an LCD according to a first illustrative embodiment of the present invention.

Referring to FIG. 1, an LCD 100 includes a backlight assembly 110, a display unit 170 and a receiving container 180.

The display unit 170 includes a liquid crystal panel 171 that displays an image, and a data driving circuit 172 and a gate driving circuit 173 that supplies driving signals to drive the liquid crystal panel 171. The data driving circuit 172 is connected to the liquid crystal panel 171 through a data tape carrier package ("data TCP") 174, and the gate driving circuit 173 is connected to the liquid crystal panel 173 through a gate tape carrier package ("gate TCP") 175.

The liquid crystal panel 171 includes a thin film transistor ("TFT") substrate 176, a color filter substrate 177 disposed to substantially face the TFT substrate 176, and a liquid crystal layer 178 interposed between the TFT substrate 176 and the color filter substrate 177.

The TFT substrate 176 may be, for example, a transparent glass substrate where switching TFTs are arranged in a matrix configuration. Each of the TFTs has a source terminal connected to a data line, a gate terminal connected to a gate line, and a drain terminal connected to a transparent conductive pixel electrode (not illustrated).

The color filter substrate 177 can be implemented, for example, using a substrate where red, green, and blue ("RGB") color pixels (not illustrated) are formed by a thin film process. A transparent conductive common electrode (not illustrated) is formed on the color filter substrate 177.

The receiving container 180 includes a bottom plate 181 and sidewalls 182 formed on edge surfaces of the bottom plate 181 to form a receiving space. The receiving container 180 receives the backlight assembly 110 and the liquid crystal panel 171 in the receiving space.

The bottom plate 181 has a sufficient surface area for receiving the backlight assembly 110. The bottom plate 181 and the backlight assembly 110 may, but need not, have the same shape. For example, in this embodiment, the bottom plate 110 and the backlight assembly may have a square, plate-like shape. The sidewalls 182 extend approximately perpendicularly from the edge surfaces of the bottom plate 181.

The LCD 100 may further include an inverter 160.

The inverter 160 is disposed outside the receiving container 180 to generate a discharge voltage for the backlight assembly 110. The discharge voltage from the inverter 160 is applied to the backlight assembly 110 through a first power supply line 163 and a second power supply line 164. The first and second power supply lines 163 and 164 are connected, respectively, to first and second electrodes 140*a* and 140*b* that are formed at opposite ends of the backlight assembly 110. Here, the first and second power supply lines 163 and 164 may be directly connected to the first and second electrodes 140*a* and 140*b*. Alternatively, the first and second power supply lines 163 and 164 may be indirectly connected to the first and second electrodes 140*a* and 140*b* using a separate connection member (not illustrated).

The LCD 100 also includes a top chassis 190. The top chassis 190 is coupled to the receiving container 180 while surrounding an edge portion of the liquid crystal panel 171. The top chassis 190 prevents the liquid crystal panel 171 from being damaged by an external impact (i.e., applied mechanical shock), and from being separated from the receiving container 180.

The LCD 100 may further include at least one optical sheet 195 to enhance characteristics of the light emitted from the backlight assembly 110. The optical sheet 195 may include a diffusion sheet to diffuse the light or a prism sheet to condense the light.

Figure 2:
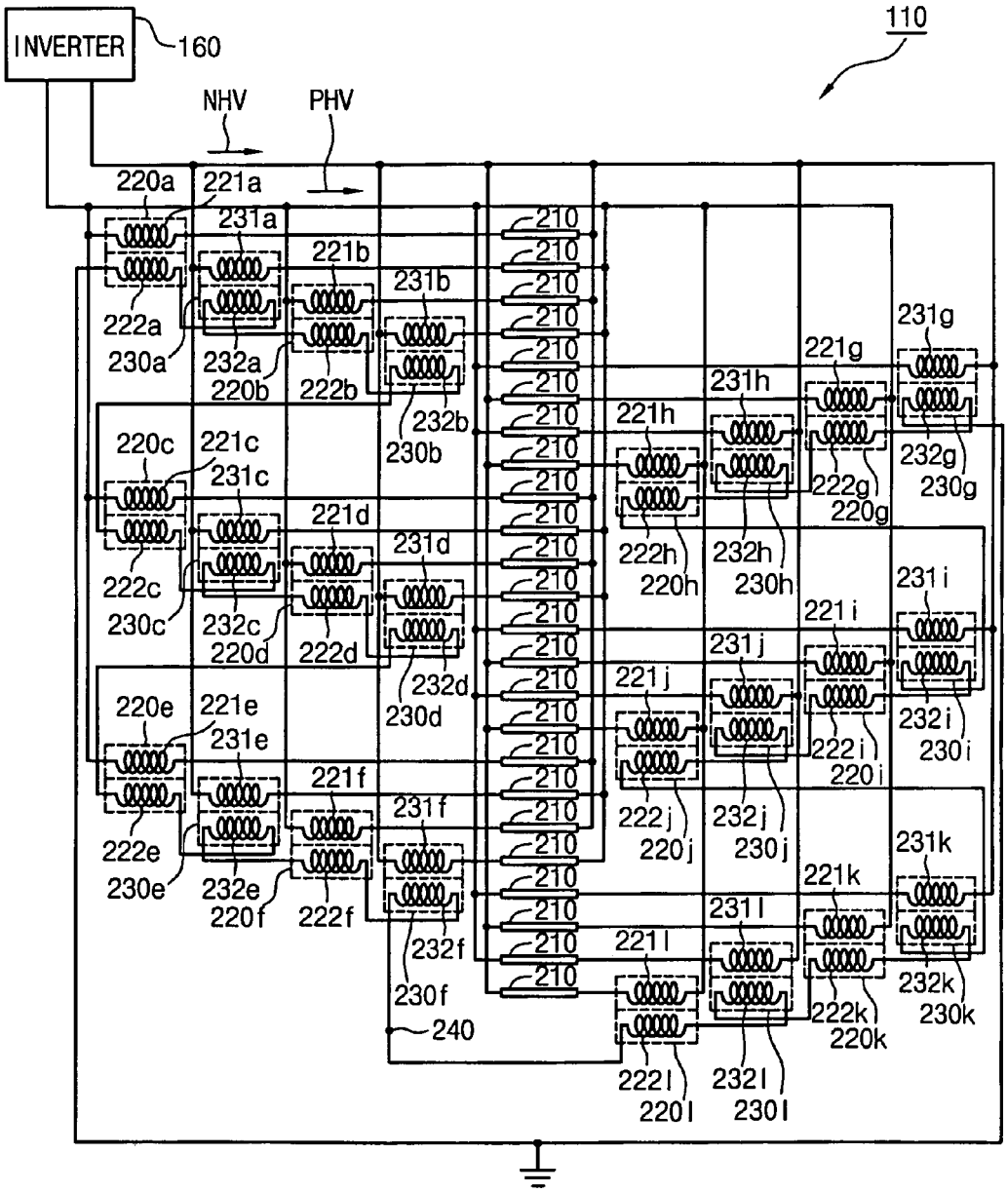
FIG. 2 is a circuit diagram of a backlight assembly according to an illustrative embodiment of the present invention.

FIG. 2 is a circuit diagram of the backlight assembly 110 according to an illustrative embodiment of the present invention.

Referring to FIG. 2, the backlight assembly 110 includes twenty-four CCFLs 210, a total of twelve first balance transformers 220*a*-220*l*, and a total of twelve second balance transformers 230*a*-230*l*. Here, the backlight assembly 110 minus the CCFLs 210 comprises an inverter circuit.

A sinusoidal voltage from the inverter 160 of FIG. 1 is applied to the CCFLs 210. This causes sinusoidal currents to flow through the CCFLs 210. That is, the CCFLs 210 are divided into two groups, and high sinusoidal voltages with opposite polarities are applied, respectively, to the two groups. In other words, the inverter 160 is configured to output both a positive high voltage ("PHV") and a negative high voltage ("NHV"). This positive high voltage/negative high voltage is applied, respectively, to the left side/right side of the odd-numbered CCFLs 210 (when numbered from the top). This positive high voltage/negative high voltage is also applied to the right side/left side, respectively of the even-numbered CCFLs 210.

The CCFLs 210 may be implemented, for example, using a general purpose CCFL known to those having ordinary skill in the relevant art. Although twenty-four CCFLs 210 are illustrated in FIG. 2, the present embodiment is not limited to this configuration. That is, the number of the CCFLs 210 provided may be any even number.

Also, the inverter 160 may be any inverter that can output both a negative high voltage ("NHV") and a positive high voltage ("PHV").

Figure 3:
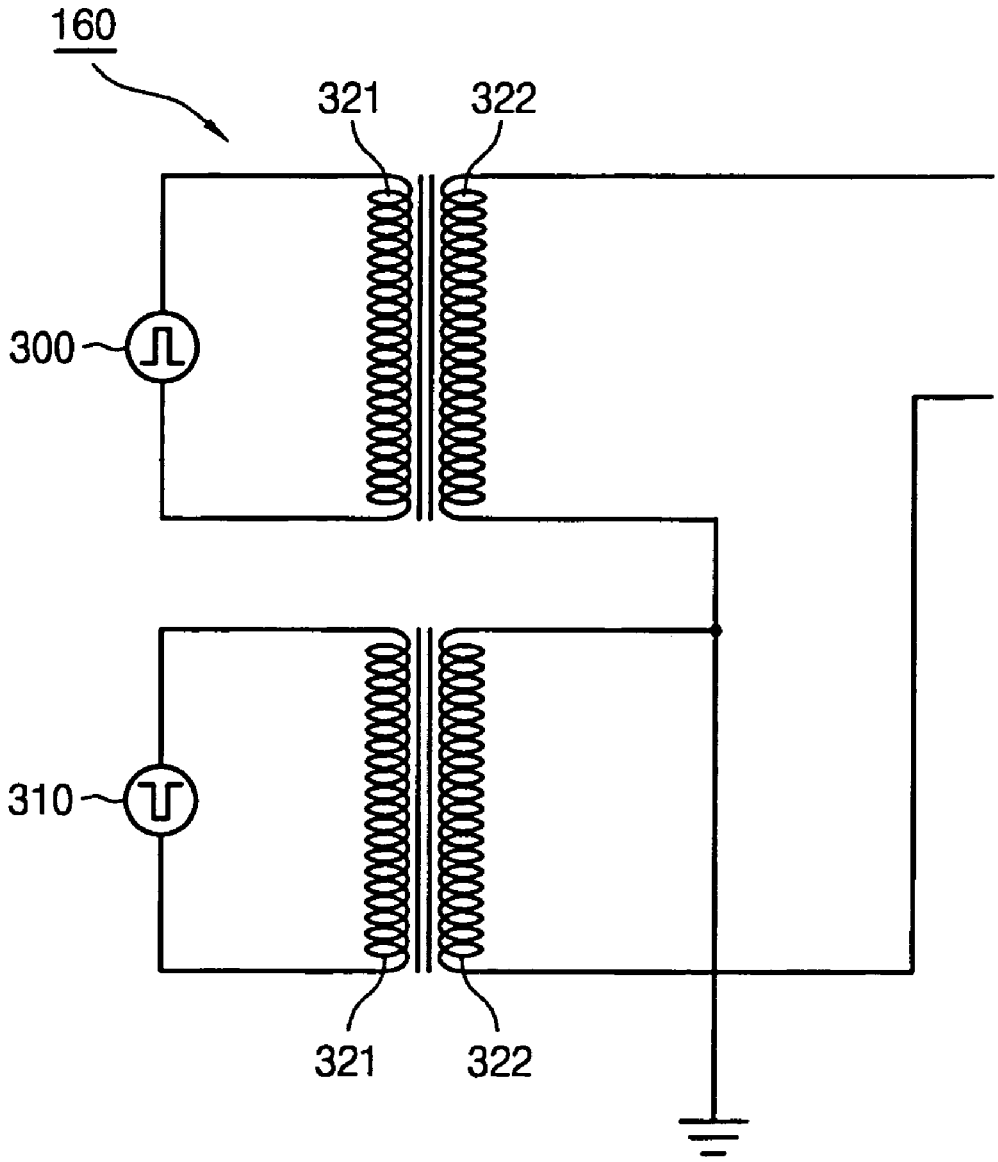
FIG. 3 is a circuit diagram of an inverter used in conjunction with an LCD according to an illustrative embodiment of the present invention.
Figure 4:
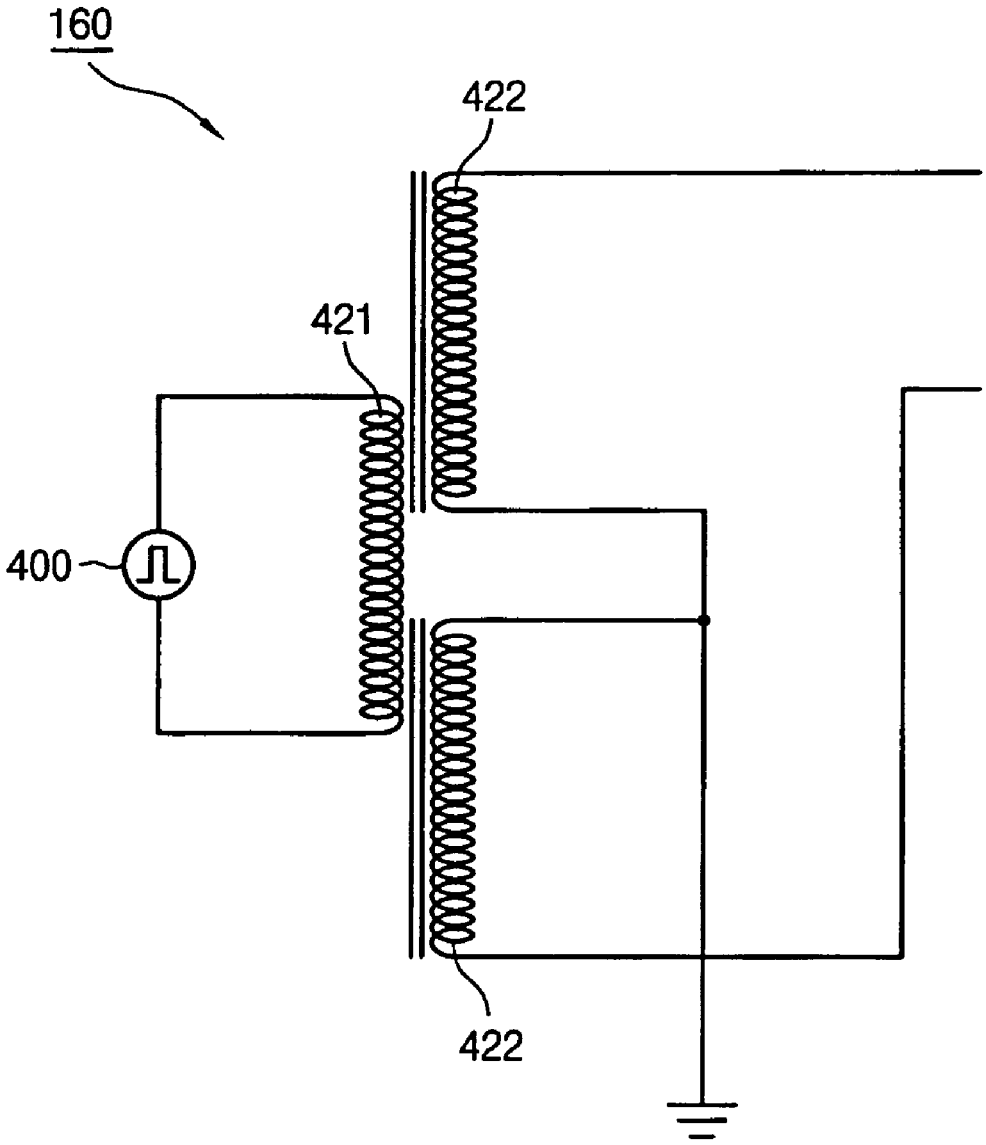
FIG. 4 is a circuit diagram of an inverter used in conjunction with an LCD according to another illustrative embodiment of the present invention.

FIGS. 3 and 4 are circuit diagrams showing exemplary embodiments of the inverter 160 according to the present invention.

Referring to FIG. 3, the inverter 160 includes two power sources 300 and 310 that output the positive high voltage ("PHV") and the negative high voltage ("NHV"), respectively, two primary coils 321 that are connected to the power sources 300 and 310, respectively, and two secondary coils 322 that are disposed adjacent to the primary coils 321, respectively.

Referring to FIG. 4, the inverter 160 includes one power source 400, one primary coil 421 connected to the power source 400, and two secondary coils 422 that are disposed adjacent to the primary coil 421. Here, the secondary coils 422 are configured such that their sinusoidal voltages have opposite polarities, thereby outputting both the positive high voltage ("PHV") and the negative high voltage ("NHV").

The first balance transformers 220*a*-220*l* and the second balance transformers 230*a*-230*l* will now be described with reference to FIG. 2. The balance transformers 220*a*-220*l* and 230*a*-230*l* include primary coils 221*a*-221*l* and 231*a*-231*l*, each of which is connected directly to a corresponding CCFL of the CCFLs 210, and secondary coils 222*a*-222*l* and 232*a*-232*l*, each of which is disposed adjacent to a corresponding primary coil of the primary coils 221*a*-221*l* and 231*a*-231*l*. When a current flows through one of the CCFLs 210, a current flows through the corresponding primary coil 221*a*-221*l* and 231*a*-231*l* and thus a current also flows through the adjacent secondary coil 222*a*-222*l* and 232*a*-232*l*. Since the secondary coils 222*a*-222*l* and 232*a*-232*l* are connected in series with one another to form a loop, the currents flowing through the secondary coils 222*a*-222*l* and 232*a*-232*l* cause currents to flow through the corresponding primary coils 221*a*-221*l* and 231*a*-231*l*. As a result, the current flowing through each of the CCFLs 210 is controlled such that a substantially equal current travels through each CCFL. The primary coils 221*a*-221*l* and 231*a*-231*l* and the secondary coils 222*a*-222*l* and 232*a*-232*l* may, but need not, provide an inductance in range of about 100 μH to about 700 μH.

In this configuration, a balancing voltage of each balance transformer 220*a*-220*l* and 230*a*-230*l* necessary to achieve balance of the CCFLs 210 can be obtained by grounding one node of the secondary coils 222*a*-222*l* and 232*a*-232*l*, and detecting a voltage between the grounded node and a detection node 240 different from the grounded node. In a normal state, the balancing voltage is in a range of about 1 volt to 2 volts.

This balancing voltage varies with the distribution of the resistances including the negative resistances of the CCFLs 210. Active use of this property enables detection of a short circuit due to a failure in the CCFLs 210. That is, when an open or short circuit occurs due to a failure in one or more of the CCFLs 210, a voltage (e.g., 5~6 V) higher than the normal voltage is detected at the detection node 240 as a result of the balancing operation of each balance transformer.

The backlight assembly 110 may further include a voltage detector to detect the voltage between the grounded node and the detection node 240. The voltage detector may be any device that can detect a voltage differential between two points.

Figure 5:
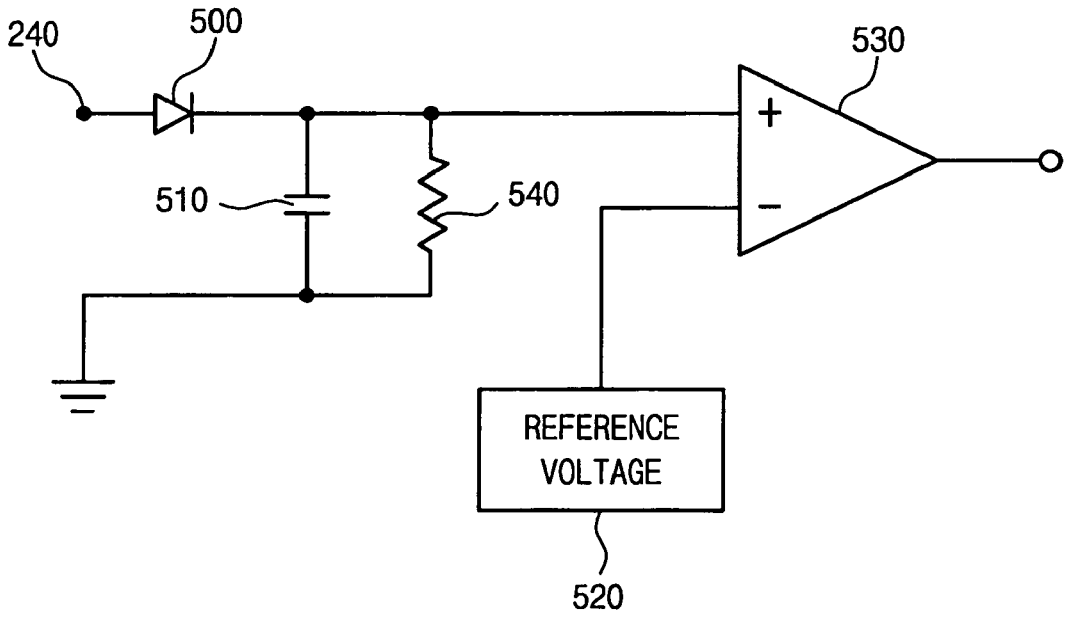
FIG. 5 is a circuit diagram of a voltage detector used in conjunction with an LCD according to an illustrative embodiment of the present invention.

FIG. 5 is a circuit diagram of the voltage detector used in the LCD according to an illustrative embodiment of the present invention.

Referring to FIG. 5, the voltage detector includes a diode 500, a capacitor 510, a resistor 540, and a comparator 530. When a reference voltage 520 is applied to the comparator 530 and the voltage between the ground voltage and the detection node 230 is higher than the reference voltage 520, the comparator 530 outputs a high signal "H". On the contrary, when the voltage between the ground voltage and the detection node 230 is lower than the reference voltage 520, the comparator 530 outputs a low signal "L".

In the backlight assembly 110 illustrated in FIG. 2, the positive high voltage ("PHV") is applied directly to half of the CCFLs 210 and applied indirectly to the other half of the CCFLs 210 through the primary coils 221*a*-221*l* of the first balance transformers 220*a*-220*l*. Likewise, the negative high voltage ("NHV") is applied directly to half of the CCFLs 210 and applied indirectly to the other half of the CCFLs 210 through the primary coils 232*a*-231*l* of the second balance transformers 230*a*-230*l*. This configuration makes it possible to balance the loads of the positive and negative high voltages ("PHV") and ("NHV"). As a result, unlike the conventional backlight assembly where a negative high voltage is applied directly to all the CCFLs and a positive high voltage is applied indirectly to all the CCFLs 910 through all the balance transformers, the backlight assembly 110 has no unbalance in positive and negative driving pulses, thereby extending the lifetime of the CCFLs 210.

SECOND ILLUSTRATIVE EMBODIMENT

Figure 6:
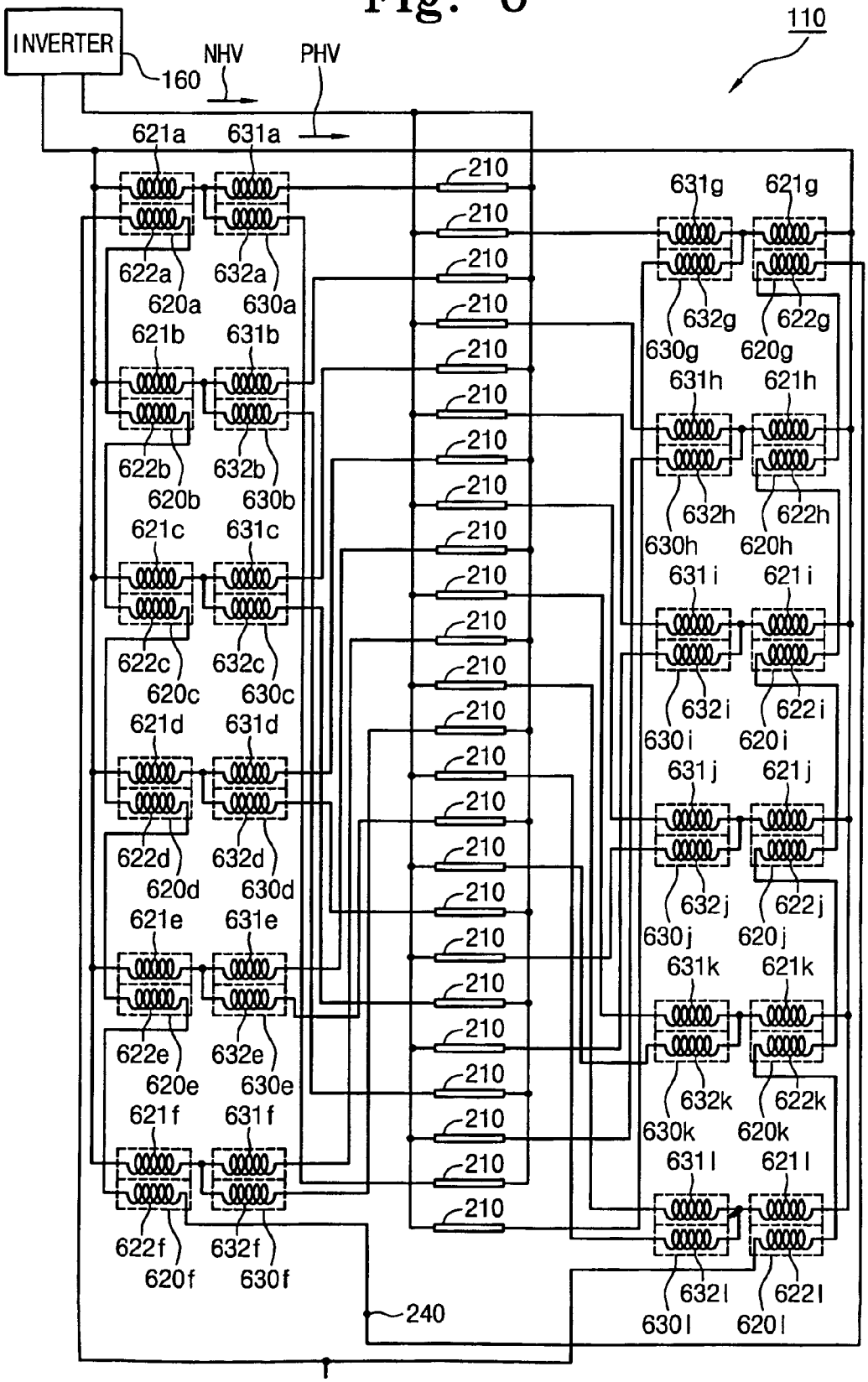
FIG. 6 is a circuit diagram of a backlight assembly according to another illustrative embodiment of the present invention.

FIG. 6 is a circuit diagram of a backlight assembly according to an illustrative embodiment of the present invention.

Referring to FIG. 6, the backlight assembly includes twenty-four CCFLs 210, a total of twelve first balance transformers 620*a*~620*l*, and a total of twelve second balance transformers 630*a*~630*l*. Here, the backlight assembly 110 minus the CCFLs 210 comprises an inverter circuit in this embodiment.

A sinusoidal voltage from the inverter 160 of FIG. 1 is applied to the CCFLs 210. This causes sinusoidal currents to flow through the CCFLs 210. That is, the CCFLs 210 are divided into two groups, and high sinusoidal voltages with opposite polarities are applied respectively to the two groups. In other words, the inverter 160 is configured to output both a positive high voltage ("PHV") and a negative high voltage ("NHV"). The positive high voltage/negative high voltage is applied, respectively, to the left side/right side of the odd-numbered CCFLs 210 (when numbered from the top). The positive high voltage/negative high voltage is also applied, respectively, to the right side/left side of the even-numbered CCFLs 210.

The CCFLs 210 and the inverter 160 have substantially similar functionalities and structures as previously described in conjunction with the first illustrative embodiment.

The first balance transformers 620*a*-620*l* and the second balance transformers 630*a*-630*l* will now be described with reference to FIG. 6. Balance transformers 620*a*-620*f* and 630*a*-630*f* are disposed at the left sides of the CCFLs 210, while balance transformers 620*g*-620*l* and 630*g*-630*l* are disposed at the right sides of the CCFLs 210.

The first balance transformers 620*a*-620*l* include, respectively, primary coils 621*a*~621*l* and secondary coils 622*a*~622*l*. The primary coils 621*a*~621*l* and the secondary coils 622*a*~622*l* have a high coupling constant and almost the same inductance, such that almost the same current flows through the primary and secondary coils 621*a*-621*l* and 622*a*-622*l*. The primary and secondary coils 621*a*-621*l* and 622*a*-622*l* of the first balance transformers 620*a*-620*l* may, but need not, have an inductance of about 700 mH. The second balance transformers 630*a*-630*l* include, respectively, primary coils 631*a*-631*l* and secondary coils 632*a*-632*l* disposed adjacent to the primary coils 631*a*-631*l*. When the secondary coils 622*a*-622*l* are connected in a loop configuration as shown in FIG. 6, almost the same current flows through the primary coils 631*a*-631*l*. The primary coils 631*a*-631*l* of the second balance transformers 630*a*-630*l* may, but need not, have an inductance of about 700 mH. The secondary coils 632*a*-632*l* of the second balance transformers 630*a*-630*l* may, but need not, have an inductance of about 50 mH. The primary coils 621*a*-621*l* of the first balance transformers are connected to the second balance transformers 630*a*~630*l*, respectively. Since the secondary coils 622*a*~622*l* of the first balance transformers 620*a*~620*l* are connected in series to form a loop configuration, currents flowing through the CCFLs 210 are controlled such that the amount of current flowing through each CCFL of CCFLs 210 is substantially equal.

With respect to backlight assembly 110, the negative high voltage ("NHV") is applied directly to the CCFLs 210, and the positive high voltage ("PHV") is applied indirectly to the CCFLs 210 through the first and second balance transformers 620*a*-620*l* and 630*a*-630*l*.

In this configuration, a balancing voltage of the first balance transformers 620*a*-620*l* to balance the CCFLs 210 can be obtained by grounding one node of the secondary coils 622*a*622*l* of the first balance transformers 630*a*-630*l* and detecting a voltage between the grounded node and a detection node 240 different from the grounded node. In a normal state, the balancing voltage is in a range of about 1 volt to 2 volts.

This balancing voltage varies with the distribution of the resistances including the negative resistances of the CCFLs 210. Active use of this property enables detection of a short circuit due to a failure in the CCFLs 210. That is, when an open or short circuit occurs due to a failure in the CCFLs 210, a voltage (e.g., 5~6 V) higher than the normal voltage is detected at the detection node 240 as a result of the balancing operation of the balance transformers.

The backlight assembly 110 may, but need not, further include a voltage detector to detect the voltage between the grounded node and the detection node 240. The voltage detector may be any device that can detect a voltage differential between the grounded node and the detection node 240.

Figure 7:
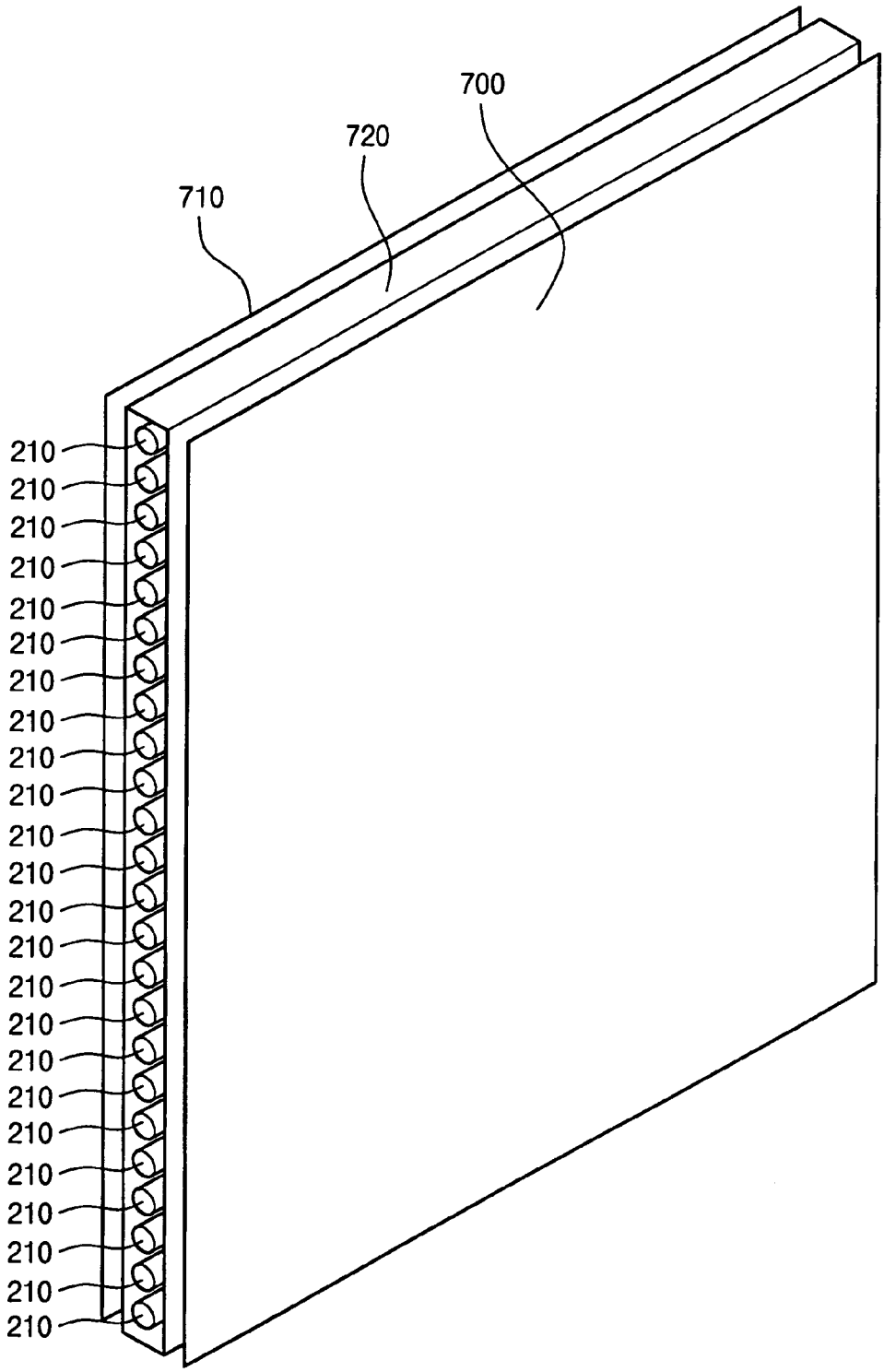
FIG. 7 is a perspective view showing an arrangement of a backlight assembly according to an illustrative embodiment of the present invention.

FIG. 7 is a perspective view illustrating an arrangement of the backlight assembly according to an illustrative embodiment of the present invention.

Referring to FIG. 7, the CCFLs 210 are disposed horizontally in a vertically-standing protection structure 720. The protection structure 720 has a rear surface covered with a reflection plate 710 and a front surface covered with a diffusion plate 700. Accordingly, temperature increases as one travels in an upward direction along diffusion plate 700. This temperature increase is attributable to heat caused by light emitted from the CCFLs 210, resulting in a temperature gradient.

The CCFLs 210 each have a temperature-dependent resistance. Therefore, due to the temperature gradient, the upper CCFLs 210 have a lower resistance, while the lower CCFLs 210 have a higher resistance.

To eliminate the resistance difference between the CCFLs 210, the balance transformers illustrated in FIG. 6 operate to balance the CCFLs 210. In the backlight assembly 110, the second balance transformers 630*a*-630*l* are disposed as illustrated in FIG. 6. The primary coil 631*a* of the balance transformer 630*a* is connected to a highest CCFL of the CCFLs 210, which is located at a highest position and has a lowest resistance, while the secondary coil 632*a* of the balance transformer 630*a* is connected to a second-lowest CCFL of the CCFLs 210 with a second-highest resistance. The primary coil 631*g* of the balance transformer 630*g* is connected to a second-highest CCFL of the CCFLs 210 with a second-lowest resistance, while the secondary coil 632*g* is connected to a lowest CCFL of the CCFLs 210 with a highest resistance. Accordingly, the sums of the resistances of the respective two CCFLs of the CCFLs 210 connected to the second balance transformers 630*a*-630*l* are averaged to reduce the distribution thereof. As a result, unlike in the conventional backlight assembly, in the backlight assembly 110 of FIG. 6, the increase in the voltage at the detection node due to the voltage difference between the respective CCFLs can be prevented from occurring during normal operation with all CCFLs functioning. Accordingly, it can be determined that an increase in a voltage detected at the detection node 240 is caused by an open or short circuit due to the failure in one or more of the CCFLs 210. Consequently, it is possible to easily troubleshoot a failure in the CCFLs 210. Additionally, in order to balance the sums of the resistances of the respective two CCFLs 210 connected to the second balance transformers 630*a*-630*l*, it is acceptable to use the connection method illustrated in FIG. 6. However, a method of connecting the fourth balance transformers 630*a*-630*l* to the CCFLs 210 is not limited to the method illustrated in FIG. 6. For example, when the CCFLs 210 are halved into a first group with higher temperatures and a second group with lower temperatures, the primary and secondary coils 631*a*~631*l* and 632*a*~632*l* of at least one of the second balance transformers 630*a*~630*l* have only to be connected to at least one of the CCFLs 210 in the first group and at least one of the CCFLs 210 in the second group, respectively.

THIRD ILLUSTRATIVE EMBODIMENT

Figure 8:
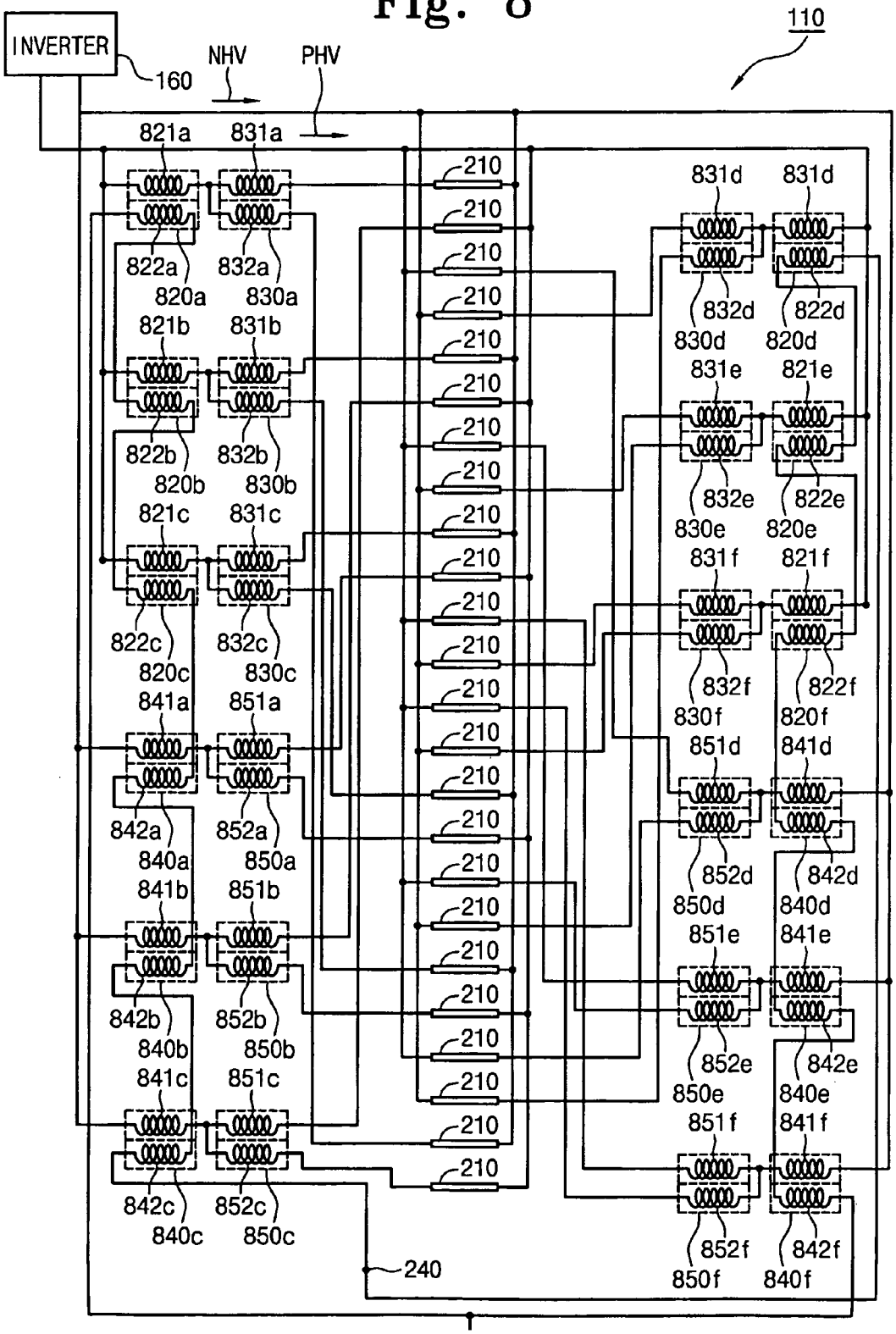
FIG. 8 is a circuit diagram of a backlight assembly according to another illustrative embodiment of the present invention.

FIG. 8 is a circuit diagram of a backlight assembly according to an illustrative embodiment of the present invention.

Referring to FIG. 8, the backlight assembly 110 includes twenty-four CCFLs 210, first balance transformers 820*a*-820*f*, second balance transformers 830*a*-830*f*, third balance transformers 840*a*~840*f*, and fourth balance transformers 850*a*~850*f*. Here, the backlight assembly 110 minus the CCFLs 210 comprises an inverter circuit.

A sinusoidal voltage from the inverter 160 of FIG. 1 is applied to the CCFLs 210. This causes sinusoidal currents to flow through the CCFLs 210. That is, the CCFLs 210 are divided into two groups, and high sinusoidal voltages with opposite polarities are applied, respectively, to these two groups. In other words, the inverter 160 is configured to output both a positive high voltage ("PHV") and a negative high voltage ("NHV"). The positive high voltage/negative high voltage is applied, respectively, to the left side/right sides of the odd-numbered CCFLs 210 (when numbered from the top). The positive high voltage/negative high voltage is also applied, respectively, to the right side/left side of the even-numbered CCFLs 210.

The CCFLs 210 and the inverter 160 have substantially similar functionalities and structures as discussed previously in connection with the first and second illustrative embodiments. The first balance transformers 820*a*-820*f*, the second balance transformers 830*a*-830*f*, the third balance transformers 840*a*-840*f*, and the fourth balance transformers 850*a*-850*f* will now be described with reference to FIG. 8.

The balance transformers 820*a*-820*c*, 830*a*-830*c*, 840*a*-840*c* and 850*a*-850*c* are disposed at the left sides of the CCFLs 210, while the balance transformers 820*d*-820*f*, 830*d*-830*f*, 840*d*-840*f* and 850*d*-850*f* are disposed at the right sides of the CCFLs 210.

Each of the first and third balance transformers 820*a* 820*f* and 840*a*-840*f* is substantially identical in structure to each of the first balance transformers 620*a*-620*l* of the second embodiment. Also, each of the second and fourth balance transformers 830*a*-830*f* and 850*a*-850*f* is substantially identical in structure to each of the second balance transformers 630*a*-630*l* of the second embodiment. Since the secondary coils 822*a*-822*f* and 842*a*-842*f* of the first and third balance transformers 820*a*-820*f* and 840*a*-840*f* are connected in series to form a loop configuration, currents flowing through the CCFLs 210 are controlled such that the amount of current flowing through each CCFL of CCFLs 210 is substantially equal.

In this configuration, a balancing voltage of the balance transformers necessary to balance the CCFLs 210 can be obtained by grounding one node of the secondary coils 822*a*-822*f* and 842*a*-842*f* of the first and third balance transformers 820*a*-820*f* and 840*a*-840*f*, and detecting a voltage between the grounded node and a detection node 240 different from the grounded node. In a normal state, the balancing voltage is in a range of about 1 V to 2 V.

This balancing voltage varies with the distribution of the resistances in the configuration of FIG. 8, including the negative resistances of the CCFLs 210. Exploiting this property enables detection of a short circuit due to a failure in any of the CCFLs 210. That is, when an open or short circuit occurs due to a failure in the CCFLs 210, a voltage (e.g., 5~6 V) higher than the normal voltage is detected at the detection node 240 as a result of the balancing operation of the balance transformer.

The backlight assembly 110 may, but need not, further include a voltage detector to detect the voltage between the grounded node and the detection node 240. The voltage detector may be any device that can detect a voltage differential between the grounded node and the detection node 240.

Figure 9:
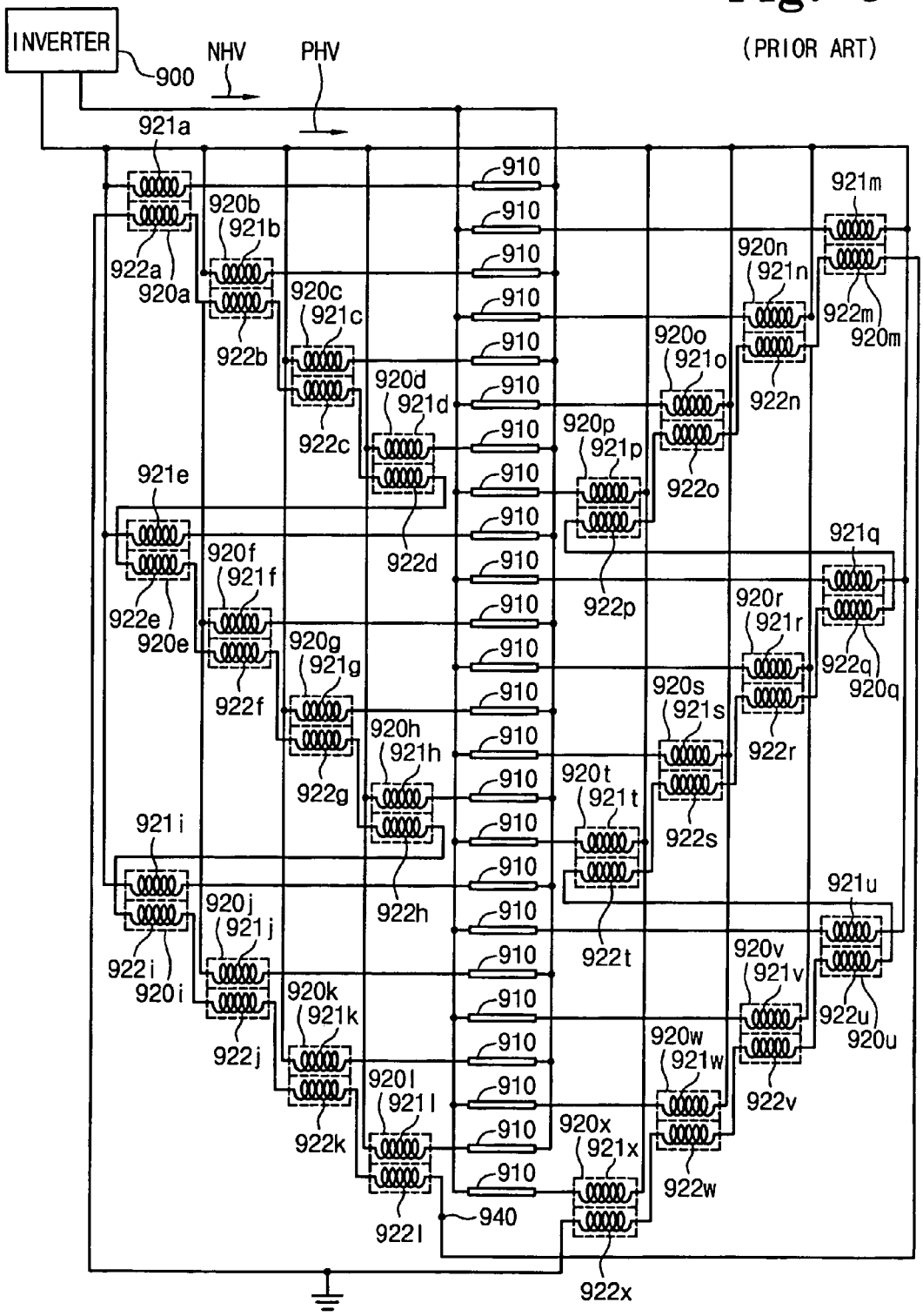
Fig. 9 (PRIOR ART)
FIG. 9 is a prior art circuit diagram of a conventional backlight assembly.
Figure 10:
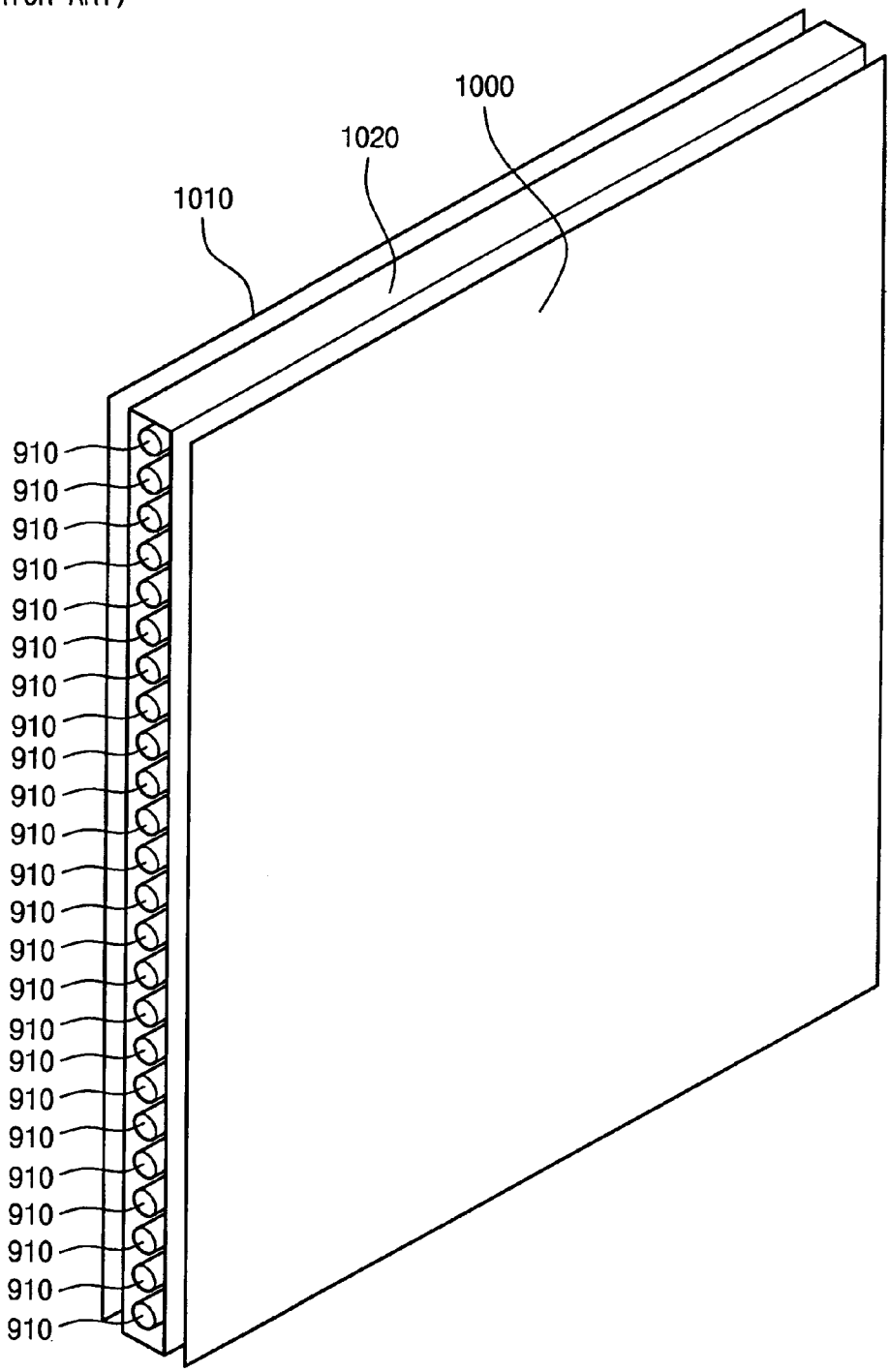
Fig. 10 (PRIOR ART)
FIG. 10 is a perspective view illustrating a prior art arrangement of the conventional backlight assembly.

In the backlight assembly 110, the positive high voltage ("PHV") is applied directly to half of the CCFLs 210 and applied indirectly to the other half of the CCFLs 210 through the first to fourth balance transformers 820*a*-820*f*, 830*a*-830*f*, 840*a*-840*f* and 850*a*-850*f*. Likewise, the negative high voltage ("NHV") is applied directly to half of the CCFLs 210 and applied indirectly to the other half of the CCFLs 210 through the first to fourth balance transformers 820*a*-820*f*, 830*a*-830*f*, 840*a*-840*f* and 850*a*-850*f*. This makes it possible to balance the loads of the positive/negative high voltages ("PHV") and ("NHV"). As a result, unlike the conventional backlight assembly where a negative high voltage is applied directly to all the CCFLs 910 and a positive high voltage is applied indirectly to all the CCFLs 910 through all the balance transformers (see FIG. 9), the backlight assembly 110 has virtually no imbalance in positive and negative driving waveforms. Accordingly, it is possible to extend the lifetime of the CCFLs.

In addition, as illustrated in FIG. 7, the CCFLs 210 are disposed horizontally in a vertically-standing protection structure 720. The protection structure 720 has a rear surface covered with a reflection plate 710 and a front surface covered with a diffusion plate 700. Accordingly, temperature increases as one moves in an upward direction along diffusion plate 700 are experienced due to heat caused by light emitted from the CCFLs 210, resulting in a temperature gradient.

The CCFLs 210 each have a temperature-dependent resistance. Therefore, due to the temperature gradient, the upper CCFLs of the CCFLs 210 have a lower resistance, while the lower CCFLs of the CCFLs 210 have a higher resistance.

To eliminate the resistance differential between the CCFLs 210, the balance transformers shown in FIG. 8 operate to balance the CCFLs 210. In the backlight assembly 110, the second and fourth balance transformers 830*a*-830*f* and 850*a*-850*f* are disposed as illustrated in FIG. 8. The primary coil 831*a* of the balance transformer 830*a* of the second balance transformers 830*a*-830*f* is connected to a highest CCFL of the CCFLs 210, which is located at a highest position and has a lowest resistance, while the secondary coil 832*a* is connected to a second-lowest CCFL of the CCFLs 210 with a second-highest resistance. The primary coil 831*d* of the balance transformer 830*d* of the second balance transformers 830*a*-830*f* is connected to a fourth-highest CCFL of the CCFLs 210 with a fourth-lowest resistance, while the secondary coil 832*d* is connected to a third-lowest CCFL of the CCFLs 210 with a third-highest resistance. Accordingly, the sums of the resistances of the respective two CCFLs of the CCFLs 210 connected to the second and fourth balance transformers 830*a*-830*f* and 850*a*-850*f* are averaged to reduce the distribution thereof. As a result, unlike in a conventional backlight assembly, in the backlight assembly 110 of this embodiment, any increase in the voltage at the detection node 240 due to the voltage difference between the respective CCFLs can be prevented from occurring during normal operation where all CCFLs are operational. Accordingly, it can be determined that an increase in a voltage detected at the detection node 240 is is caused by an open or short circuit due to a failure in one or more CCFLs of CCFLs 210. Consequently, it is possible to easily troubleshoot a failure in the CCFLs 210. Additionally, in order to balance the sums of the resistances of the respective two CCFLs connected to the second and fourth balance transformers 830*a*-830*f* and 850*a*-850*f*, it is acceptable to use the connection configuration illustrated in FIG. 8. However, a configuration that connects the second and fourth balance transformers 830*a*-830*f* and 850*a*-850*f* to the CCFLs 210 is not limited to the configuration illustrated in FIG. 6. For example, when the CCFLs are halved into a first group with higher temperatures and a second group with lower temperatures, the first and secondary coils of at least one of the second and fourth balance transformers 830*a*-830*f* and 850*a*-850*f* have only to be connected to at least one of the CCFLs 210 in the first group and at least one of the CCFLs 210 in the second group, respectively.

In this way, a backlight assembly 210 constructed in accordance with this embodiment makes it possible to easily troubleshoot a failure in the CCFLs while extending the lifetime of the CCFLs.

According to the present invention, the inverter circuit and the backlight assembly may extend the lifetime of the CCFLs. Also, the inverter circuit and the backlight assembly allow for readily troubleshooting a failure in the CCFLs.

Pursuant to various illustrative embodiments in accordance with the foregoing description, the inverter circuit and the backlight assembly apply, a first sinusoidal voltage (e.g., a positive high voltage) and a second sinusoidal voltage (e.g., a negative high voltage) to a first terminal of n CCFLs among 2n CCFLs through respective primary coils of n balance transformers. Accordingly, the inverter circuit and the backlight assembly can balance loading of the positive high and negative high voltages relative to conventional inverter circuits and conventional backlight assemblies. Consequently, the backlight assembly and the inverter circuit constructed in accordance with various preferred embodiments disclosed herein extends the lifetime of the CCFLs.

Also, pursuant to various illustrative embodiments disclosed herein, in the inverter circuit and the backlight assembly, at least one of the primary and secondary coils of n second balance transformers is connected in series with at least one of n CCFLs with higher temperatures and at least one of n second CCFLs with lower temperatures. Accordingly, it is possible to reduce the distribution of the sums of the resistances of the respective two CCFLs connected to n second balance transformers, to thereby readily troubleshoot the failure of the CCFLs in the backlight assembly and the LCD.

Also, pursuant to various illustrative embodiments disclosed herein, the inverter circuit and the backlight assembly applies a first sinusoidal voltage (e.g., a positive high voltage) and a second sinusoidal voltage (e.g., a negative high voltage) to respective first terminals of n CCFLs among 2n CCFLs through primary coils of n balance transformers. Also, at least one of the primary and secondary coils of n second balance transformers is connected in series with at least one of n CCFLs having a higher temperature during operation and at least one of n CCFLs having a lower temperature during operation. Further, at least one of the primary and secondary coils of n fourth balance transformers is connected in series to at least one of n CCFLs having a higher temperature during operation and at least one of n CCFLs having a lower temperature during operation. Thus, any failure in the CCFLs may be readily identified while, at the same time, the life span of the CCFLs is extended.

It will be apparent to those skilled in the art that various modifications, changes, or variations can be made to the present invention. Thus, the present invention encompasses such modifications, changes as defined by the scope of the appended claims and equivalents thereof.

What is claimed is:

1. An inverter circuit that applies sinusoidal voltages to 2n CCFLs wherein n is a positive integer, the inverter circuit comprising:

n first balance transformers each including a primary coil and a secondary coil; and n second balance transformers each including a primary coil and a secondary coil, wherein a first sinusoidal voltage and a second sinusoidal voltage are applied, respectively, to a corresponding first terminal and a corresponding second terminal of each of the 2n CCFLs, the first sinusoidal voltage being substantially opposite in polarity to the second sinusoidal voltage;

each respective primary coil of the n first balance transformers is connected in series with a corresponding first terminal of a CCFL included in a first set of n CCFLs from the 2n CCFLs, such that the first sinusoidal voltage is applied to each respective first terminal of the first set of n CCFLs while the second sinusoidal voltage is applied to each respective second terminal of the first set of n CCFLs;

each respective primary coil of the n second balance transformers is connected in series with a corresponding first terminal of a CCFL included in a second set of n CCFLs from the 2n CCFLs, such that the second sinusoidal voltage is applied to each respective first terminal of the second set of n CCFLs while the first sinusoidal voltage is applied to each respective second terminal of the second set of n CCFLs; wherein the first set of n CCFLs is mutually exclusive with the second set of n CCFLs; and the secondary coils of the first balance transformers and the secondary coils of the second balance transformers are all connected in series with each other to form a loop.

2. The inverter circuit of claim 1, wherein a first circuit node is connected to one secondary coil of the first balance transformer and one secondary coil of the second balance transformer, the first circuit node being grounded, and the inverter circuit further comprises a voltage detector to detect a voltage between the grounded first circuit node and a detection node different from the grounded first circuit node.

3. The inverter circuit of claim 1, wherein the first set of n CCFLs are designated as odd-numbered CCFLs and the second set of n CCFLs are designated as even-numbered CCFLs.

4. An inverter circuit that applies sinusoidal voltages to 2n CCFLs, wherein 2n is a positive integer, the inverter circuit comprising:

n first balance transformers each including a primary coil and a secondary coil; and n second balance transformers each including a primary coil and a secondary coil, wherein a first sinusoidal voltage and a second sinusoidal voltage are applied, respectively, to a corresponding first terminal and a corresponding second terminal of each of the 2n CCFLs, the first sinusoidal voltage being substantially opposite in polarity to the second sinusoidal voltage;

wherein respective n second balance transformers are connected with corresponding first terminals of a first set of n CCFLs from the 2n CCFLs through corresponding primary coils of n first balance transformers such that the first sinusoidal voltage is applied to the first terminals of the first set of n CCFLs while the second sinusoidal voltage is applied to second terminals of the first set of n CCFLs;

wherein respective n second balance transformers are connected with first terminals of a second set of n CCFLs from the 2n CCFLs through corresponding primary coils of n first balance transformers such that the second sinusoidal voltage is applied to the first terminals of the second set of n CCFLs while the first sinusoidal voltage is applied to the second terminals of the second set of n CCFLs; wherein the first set of n CCFLs is mutually exclusive with the second set of n CCFLs;

the primary coil and the secondary coil of each of the second balance transformers are connected in series with at least one of n CCFLs having a higher temperature during operation of the 2n CCFLs and to at least one of n CCFLs having a lower temperature during operation of the 2n CCFLs; and the secondary coils of the first balance transformers are connected in series with one another to form a loop.

5. The inverter circuit of claim 4, wherein a grounded circuit node is connected to one secondary coil of the first balance transformers, and the inverter circuit further comprises a voltage detector to detect a voltage differential between the grounded circuit node and a detection node remotest from the grounded point.

6. The inverter circuit of claim 4, wherein the first set of n CCFLs are designated as odd-numbered CCFLs, and the second set of n CCFLs are designated as even-numbered CCFLs.

7. An inverter circuit that applies sinusoidal voltages to 2n CCFLs, wherein n is a positive integer, the inverter circuit comprising:

n/2 first balance transformers each including a primary coil and a secondary coil;

n/2 second balance transformers each including a primary coil and a secondary coil;

n/2 third balance transformers each including a primary coil and a secondary coil; and n/2 fourth balance transformers each including a primary coil and a secondary coil, wherein a first sinusoidal voltage and a second sinusoidal voltage are applied, respectively, to a corresponding first terminal and a corresponding second terminal of each of 2n CCFLs, the first sinusoidal voltage being substantially opposite in polarity to the second sinusoidal voltage;

each of respective second balance transformers are connected in series with corresponding first terminals of a first set of n CCFLs from the 2n CCFLs through the primary coils of the first balance transformers such that the first sinusoidal voltage is applied to the first terminals of the first set of n CCFLs while the second sinusoidal voltage is applied to second terminals of the second set of n CCFLs; wherein the first set of n CCFLs is mutually exclusive with the second set of n CCFLs;

each of respective fourth balance transformers are connected in series with corresponding first terminals of a second set of n CCFLs from the 2n CCFLs through the primary coils of the third balance transformers such that the second sinusoidal voltage is applied to the first terminals of the first set of n CCFLs while the first sinusoidal voltage is applied to the second terminals of the first set of n CCFLs;

the primary and secondary coils of the second balance transformer are connected in series to at least one of n/2 CCFLs of the first set of n CCFLs having a higher temperature during operation of the 2n CCFLs and to at least one of n/2 CCFLs of the first set of n CCFLs having a lower temperature during operation of the 2n CCFLs;

the primary and secondary coils of the fourth balance transformer are connected in series with at least one of n/2

CCFLs of the second set of n CCFLs having a higher temperature during operation of the 2n CCFLs and to at least one of n/12 CCFLs of the second set of n CCFLs having a lower temperature during operation of the 2n CCFLs; and the secondary coils of the first and third balance transformers are connected in series with one another to form a loop.

8. The inverter circuit of claim 7, wherein a first circuit node connected to the secondary coils of the first and third balance transformers is grounded, and the inverter circuit further comprises a voltage detector for detecting a voltage differential between the grounded first circuit node and a detection node different from the grounded first circuit node.

9. The inverter circuit of claim 7, wherein the first set of n CCFLs are designated as odd-numbered CCFLs and the second set of n CCFLs are designated as even-numbered CCFLs.

10. A backlight assembly comprising:

2n CCFLs that emit light in response to sinusoidal voltages, wherein n is a positive integer; and an inverter circuit to apply the sinusoidal voltages to the 2n CCFLs, the inverter circuit comprising:

n first balance transformers each including a primary coil and a secondary coil; and n second balance transformers each including a primary coil and secondary coils, wherein a first sinusoidal voltage and a second sinusoidal voltage are applied, respectively, to a corresponding first terminal and a corresponding second terminal of each of 2n CCFLs, the first sinusoidal voltage being substantially opposite in polarity to the second sinusoidal voltage;

each respective primary coil of the n first balance transformers is connected in series with a corresponding first terminal of a CCFL included in a first set of n CCFLs from the 2n CCFLs, such that the first sinusoidal voltage is applied to each respective first terminal of the first set of n CCFLs while the second sinusoidal voltage is applied to each respective second terminal of the first set of n CCFLs;

each respective primary coil of the n second balance transformers is connected in series with a corresponding first terminal of a CCFL included in a second set of n CCFLs from the 2n CCFLs, such that the second sinusoidal voltage is applied to each respective first terminal of the second set of n CCFLs while the first sinusoidal voltage is applied to each respective second terminal of the second set of n CCFLs; wherein the first set of n CCFLs is mutually exclusive with the second set of n CCFLs; and the secondary coils of the first balance transformers and the secondary coils of the second balance transformers all are connected in series with each other to form a loop.

11. The backlight assembly of claim 10, wherein a first circuit node connected to one secondary coil of the first balance transformer and one secondary coil of the second balance transformer is grounded, and the inverter circuit further comprises a voltage detector to detect a voltage differential between the grounded first circuit node and a detection node different from the grounded first circuit node.

12. The backlight assembly of claim 10, wherein the first set of n CCFLs are designated as odd-numbered CCFLs and the second set of n CCFLs are designated as even-numbered CCFLs.

13. A liquid crystal display comprising:

a liquid crystal panel that displays an image in response to light incident thereupon;

a backlight assembly comprising:

2n CCFLs that emits light in response to sinusoidal voltages, wherein n is a positive integer; and an inverter circuit to apply the sinusoidal voltages to the 2n CCFLs, the inverter circuit comprising:

n first balance transformers each including a primary coil and a secondary coil; and n second balance transformers each including a primary coil and secondary coil, wherein a first sinusoidal voltage and a second sinusoidal voltage are applied, respectively, to a corresponding first terminal and a corresponding second terminal of each of the 2n CCFLs, the first sinusoidal voltage being substantially opposite in polarity to the second sinusoidal voltage;

each respective primary coil of the n first balance transformers is connected in series with a corresponding first terminal of a CCFL included in a first set of n CCFLs from the 2n CCFLs, such that the first sinusoidal voltage is applied to each respective first terminal of the first set of n CCFLs while the second sinusoidal voltage is applied to each respective second terminal of the first set of n CCFLs;

each respective primary coil of the n second balance transformers is connected in series with a corresponding first terminal of a CCFL included in a second set of n CCFLs from the 2n CCFLs, such that the second sinusoidal voltage is applied to each respective first terminal of the second set of n CCFLs while the first sinusoidal voltage is applied to each respective second terminal of the second set of n CCFLs; wherein the first set of n CCFLs is mutually exclusive with the second set of n CCFLs;

and the secondary coils of the first balance transformers and the secondary coils of the second balance transformers are all connected in series with each other to form a loop.

14. The liquid crystal display of claim 13, wherein a first circuit node connected to one secondary coil of the first balance transformer and one secondary coil of the second balance transformer is grounded, and the inverter circuit further comprises a voltage detector to detect a voltage differential between the grounded first circuit node and a detection node different from the grounded first circuit node.

15. The liquid crystal display of claim 13, wherein the first set of n CCFLs are designated as odd-numbered CCFLs and the second set of n CCFLs are designated as even-numbered CCFLs.

* * * * *